US006743108B2

(12) United States Patent
Hunter

(10) Patent No.: US 6,743,108 B2
(45) Date of Patent: Jun. 1, 2004

(54) RANDOM PATH FLUME RIDE

(75) Inventor: Richard D. Hunter, Ottawa (CA)

(73) Assignee: Proslide Technology Inc., Ottawa (CA)

( * ) Notice: Subject to any disclaimer, the term of this patent is extended or adjusted under 35 U.S.C. 154(b) by 0 days.

(21) Appl. No.: 10/021,569

(22) Filed: Dec. 12, 2001

(65) Prior Publication Data

US 2002/0142851 A1 Oct. 3, 2002

Related U.S. Application Data

(60) Provisional application No. 60/322,882, filed on Sep. 17, 2001, and provisional application No. 60/255,517, filed on Dec. 12, 2000.

(51) Int. Cl.[7] ..... A63G 21/18

(52) U.S. Cl. ..... 472/117; 472/116; 472/128; 104/69

(58) Field of Search ..... 472/116, 117, 472/128, 134, 89, 90; 104/53, 69, 70

(56) References Cited

U.S. PATENT DOCUMENTS 4,339,122 A * 7/1982 Croul ..... 104/70
4,805,897 A * 2/1989 Dubeta ..... 472/117
5,011,134 A * 4/1991 Langford ..... 104/70
5,137,497 A * 8/1992 Dubeta ..... 472/117
5,230,662 A * 7/1993 Langford ..... 472/117
5,433,671 A * 7/1995 Davis ..... 472/117
5,779,553 A * 7/1998 Langford ..... 104/73
6,450,891 B1 9/2002 Dubeta

* cited by examiner

*Primary Examiner*—Kien T. Nguyen
(74) *Attorney, Agent, or Firm*—Jonathan A. Barney

(57) ABSTRACT

The invention provides an improved water flume ride having one or more slide effects for presenting multiple random flume paths to riders. In one embodiment, a water flume comprises a primary flume portion, an uphill embankment culminating in a crest, and two or more adjoining secondary flume portions. The secondary flume portions provide mutually exclusive ride paths which are selected according to the particular kinetic energy and/or momentum possessed by a rider ascending toward the crest of the uphill embankment.

24 Claims, 11 Drawing Sheets

FIG. 13A
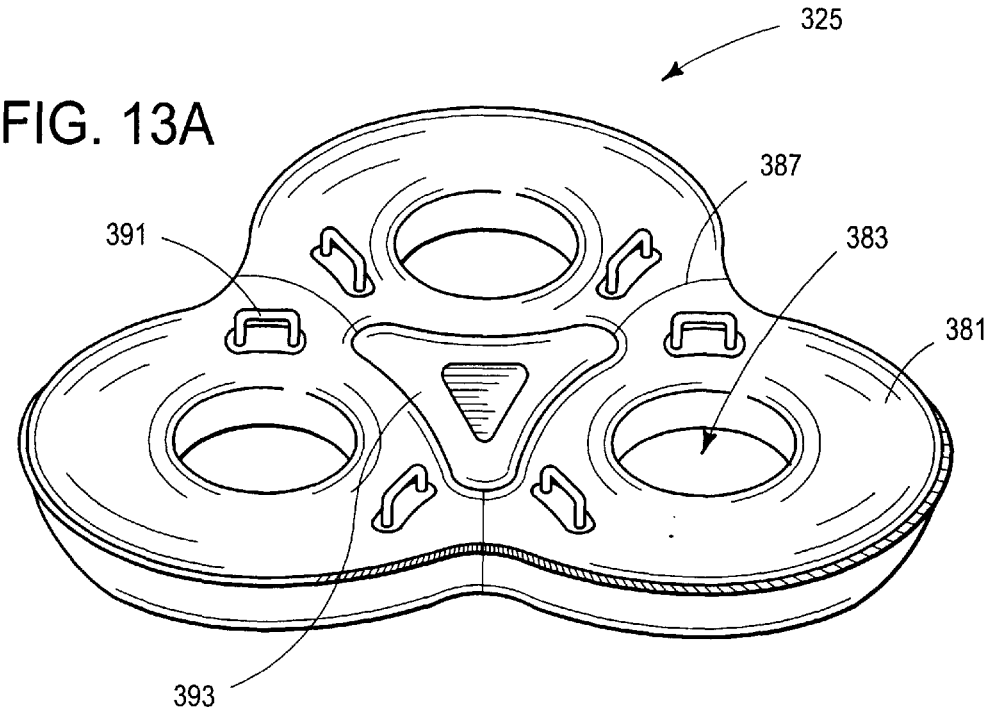
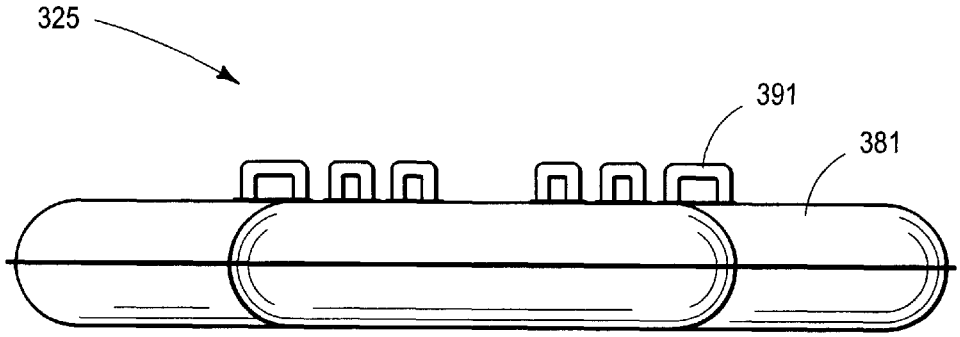
FIG. 13B
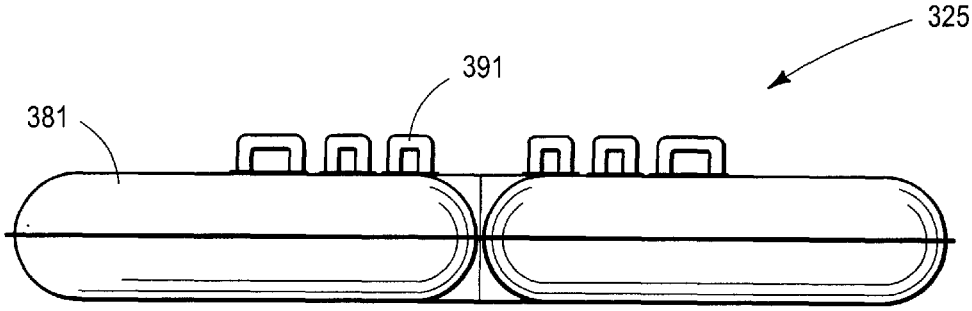
FIG. 13C

RANDOM PATH FLUME RIDE

RELATED APPLICATIONS

This application claims priority under 35 U.S.C. §119(e) to provisional application U.S. Ser. No. 60/322,882, filed Sep. 17, 2001. This application also claims priority under 35 U.S.C. §119(e) to provisional application U.S. Ser. No. 60/255,517 filed Dec. 12, 2000.

BACKGROUND OF THE INVENTION

1. Field of the Invention

The invention relates in general to flume rides, and more particularly, to an improved water flume ride having two or more randomly determined ride paths.

2. Description of the Related Art

Water slides, flumes and the like are popular ride attractions for water parks, theme parks, family entertainment centers and destination resorts. Water slides not only offer welcome relief from the summer heat, they also provide an exiting and entertaining diversion from conventional pool and/or ocean bathing activities.

In a typical water slide or flume, a bather or rider slides his body and/or a flexible riding mat or tube ("ride vehicle") along a downward-inclined sliding surface defined by a flume or water channel that bends, twists and turns following a predetermined ride path. The flume also typically carries a flow of water from a starting pool at some desired higher elevation to a landing pool or run-out at a desired lower elevation. The water is typically continuously recirculated from the lower elevation to the higher elevation using one or more pumps and then continuously falls with gravity from the higher elevation to the lower elevation flowing along the slide/flume path. The water provides cooling fun for the ride participants, and also provides a lubricious film or fluid between the rider/vehicle and the ride surface so as to increase the speed of the rider down the flume path.

The popularity of such water slide rides has increased dramatically over the years, as they have proliferated and evolved into ever larger and more exciting rides. Nevertheless, park patrons continue to demand and seek out more and more exiting and stimulating ride experiences. Thus, there is an ever present demand and need for different and more exiting flume ride designs that offer riders a new and unique ride experience and that give park owners the ability to draw larger and larger crowds to their parks.

SUMMARY OF THE INVENTION

The present invention addresses these and other needs and demands by providing an improved flume ride and associated slide effect offering riders a new and unique ride experience unlike any other they have experienced before. In particular, a flume ride is provided having two or more diverging flume paths configured and arranged such that a rider's flume ride experience and his or her path along the flume ride sliding surface is randomly determined.

In general, a first flume path is provided with a downhill portion culminating in a short uphill embankment portion. Beyond the uphill embankment portion, the flume ride continues with a second downhill portion ("upper flume path") followed by such additional uphill and/or downhill portions or other slide special effects as may be desired. The uphill embanked portion also adjoins a third generally downhill embankment path running essentially parallel to the uphill embankment and rejoining an adjacent lower flume ("lower flume path"). The arrangement and connection of the structures is such that a rider can ride down the first downhill portion, up the uphill embankment and then either ride over the uphill embankment to the upper flume path or slide back down the uphill embankment and down the adjoining lower flume path.

In operation, as the rider approaches and enters the uphill embankment portion some or all of the rider's kinetic energy is converted to potential energy. If all of the rider's kinetic energy is depleted (e.g., dissipated by friction losses and/or converted to potential energy) before the rider reaches the crest of the uphill embankment, the rider returns downward along the downward embankment portion to a lower flume. On the other hand, if the all of the rider's kinetic energy is not depleted before the rider reaches the crest of the uphill embankment, the rider continues over the crest of the uphill embankment to an upper flume beyond the uphill embankment. In this manner the rider's path along the water flume ride is not predetermined, but may be randomly altered (or otherwise changed) in accordance with varying levels of kinetic and potential energy which may be possessed by a rider and/or ride vehicle traveling along the flume ride. For convenience of description, this slide effect is referred to herein as an "over-under" effect. The path of the rider/vehicle depends on whether the rider's kinetic energy and/or momentum is over or under the amount necessary to overcome the potential energy at the crest of the uphill embankment.

Preferably, both the upper and lower flume paths treat the riders to different ride experiences or journeys. The remaining portions of the flume ride may be completely different or may rejoin downstream of the over-under effect. These paths may or may not rejoin and/or further diverge via additional over-under effects at such downstream portions as may be desired. Preferably, the length and downhill grade of all possible flume paths are such that the time for a rider to traverse each randomly determined path from a defined beginning point to a defined ending point is substantially approximately equal. Advantageously, this ensures that, while the rider's path is effectively random (i.e., not necessarily predetermined), the flume ride operation is still predictable to the ride operator because the various flume paths can be timed so as to have the same or substantially the same ride duration. Thus, the ride in accordance with one preferred embodiment of the invention is capable of sustaining relatively high rider and/or ride vehicle throughput with start intervals of between about 10 to 20 seconds per flume.

In one embodiment, the invention generally provides a water flume ride comprising a primary flume portion, an uphill embankment portion, and two or more adjoining secondary flume portions. The secondary flume portions present riders with mutually exclusive ride paths which are selected according to the amount of kinetic energy and/or momentum possessed by a rider ascending toward the crest of the uphill embankment portion.

In another embodiment, the invention provides a flume ride comprising a generally downwardly-inclined main slide path sized and adapted to carry one or more riders and/or ride vehicles sliding thereon. Each rider and/or ride vehicle has a kinetic energy and/or momentum associated with it, in accordance with its particular speed and mass. A multi-path slide effect is provided for safely intercepting at least some of the riders and/or ride vehicles and redirecting them to one or more auxiliary slide paths. The multi-path slide effect comprises an energy threshold gate device positioned at a selected desired point along the main slide path. The gate device is configured and adapted to successively intercept moving riders and/or ride vehicles and to deplete therefrom a threshold amount of kinetic energy and/or momentum. The gate devise is adapted to thereby discriminate and separate successive riders and/or ride vehicles according to whether their associated kinetic energy and/or momentum is greater than or less than the threshold amount. A first auxiliary slide path is arranged and adapted to receive and pass those riders and/or ride vehicles whose kinetic energy and/or momentum is greater than the threshold amount determined by the energy threshold gate. A second auxiliary slide path is arranged and adapted to receive and pass those riders and/or ride vehicles whose kinetic energy and/or momentum is less than the threshold amount determined by the energy threshold gate. The energy threshold gate device may comprises a simple uphill embankment portion culminating in a crest, or it may comprise any one or more of a variety of other momentum or energy discriminating means, such as friction surfaces, braking mechanisms, injected water flow, water jets and/or the like.

In another embodiment, the invention provides an improved flume ride wherein riders slide along a sliding surface. A first generally downhill portion is provided transitioning into an uphill embankment portion culminating at a crest. A first divergent flume path is provided comprising a second generally downhill portion following the crest of the uphill embankment portion. A second divergent flume path is provided comprising a third generally downhill portion extending generally parallel to and at least partially adjoining the uphill embankment portion. The first, second and third downhill portions and the uphill embankment portions are all sized and arranged such that one or more riders sliding along the flume ride slide down the first downhill portion and up the uphill embankment, and then continue sliding either: (i) over the crest of the uphill embankment and down the second downhill portion comprising the first divergent flume path, or (ii) back down the uphill embankment portion and down the third downhill portion comprising the second divergent path. The first and second divergent flume paths may or may not rejoin, as desired.

In another embodiment, the invention provides, in a slide or flume ride comprising a generally downwardly-inclined main slide path carrying moving riders and/or ride vehicles sliding thereon, a method for safely intercepting at least some of the riders and/or ride vehicles and redirecting them to one or more auxiliary slide paths. An uphill embankment portion is formed at one or more selected points along the main slide path and culminating in a crest and a subsequent first downhill embankment portion defining a first auxiliary slide path. A second downhill embankment portion is provided generally adjoining the uphill embankment portion and defining a second auxiliary slide path. Successive riders and/or ride vehicles are caused to slide down the main slide path and to slide up the uphill embankment portion, thereby converting at least some of the kinetic energy of the rider and/or ride vehicle to potential energy. If all of the kinetic energy is depleted before the rider and/or ride vehicle reaches the crest of the uphill embankment portion, the rider and/or ride vehicle substantially reverses direction, and slides back down the uphill embankment portion and continues down the second downhill embankment portion along the second auxiliary path. Alternatively, if all of the kinetic energy is not depleted before the rider and/or ride vehicle reaches the crest of the uphill embankment portion, the rider and/or ride vehicle substantially continues in motion and slides over the crest of the uphill embankment and down the first downhill embankment portion along the first auxiliary path.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which:

FIGS. 13A–C are perspective, corner and side elevation views, respectively of an integral triple tube ride raft vehicle for use with the water flume ride having features and advantages of the present invention.

DESCRIPTION OF THE PREFERRED EMBODIMENTS

Figure 1A:
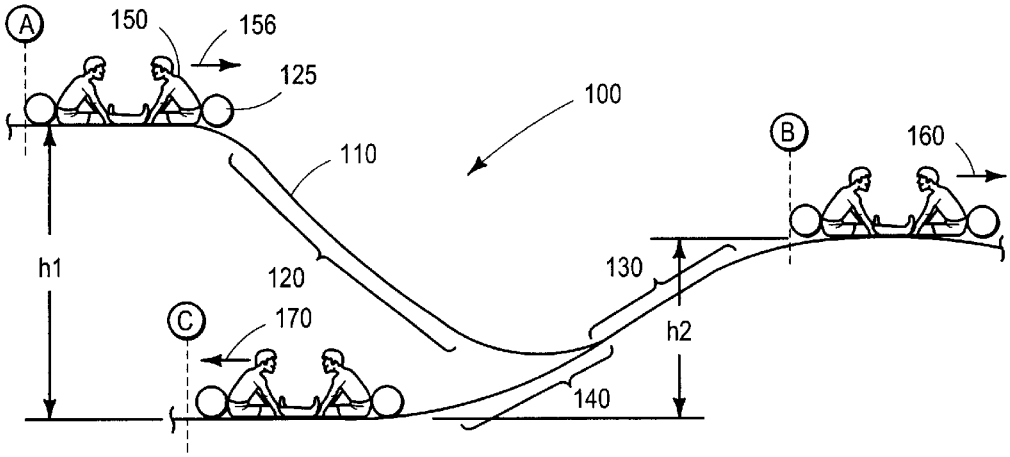
FIG. 1 is a simplified schematic illustration of one embodiment of a water flume ride having features and advantages in accordance with the present invention.

FIG. 1A is a simplified schematic illustration of one possible embodiment of a flume ride 100 having features and advantages in accordance with the present invention. The flume ride 100 generally, comprises a sliding surface 110 comprising a water channel or flume (e.g., a slide, tunnel, tube, extended flat surface, etc.) and having a first downward-inclined portion 120 beginning from a first elevation $h_1$, an upward-inclined portion 130 cresting at a second elevation $h_2$ lower than the first elevation $h_1$, and a second downward-inclined portion 140 generally adjoining the upward-inclined portion 130. As illustrated, the first downward-inclined portion 120 begins at point "A" and generally smoothly transitions into an uphill embankment portion comprising upward-inclined portion 130 culminating at a crest at point "B." Beyond the upward-inclined portion 130, the sliding surface 110 continues along a first defined path 160 ("the upper flume path") with such additional downhill and/or uphill portions and/or other slide effects as may be desired.

As illustrated in FIG. 1A, the uphill embankment portion of the sliding surface 110 also smoothly transitions into a generally downhill embankment comprising the second downward-inclined portion 140. Beyond the second downward-inclined portion 140 (point "C"), the sliding surface 110 continues along a second defined path 170 ("the lower flume path") with such additional downhill and/or uphill portions and/or other slide effects as may be desired.

In operation, one or more bathers or riders 150 slide via their bodies and/or via a riding mat or inflatable tube 125 ("ride vehicle"—see, e.g., FIGS. 13, 14) along the flume or water channel 110. Starting at point "A" the rider 150 and/or ride vehicle 125 initiate a downward descent along the first downward-inclined portion 120. During this portion of the ride, the rider 150 and/or ride vehicle 125 gain kinetic energy and momentum due to the resulting decrease in elevation and the lubricious nature of the sliding surface 110. As the rider 150 transitions into and enters the uphill embankment portion 130, some or all of the rider's kinetic energy and momentum is depleted due to frictional losses and/or conversion of kinetic energy to potential energy. If all of the rider's kinetic energy and momentum is thereby depleted before the rider reaches the crest of the uphill embankment 130 (point "B"), the rider 150 and/or ride vehicle 125 will substantially reverse its motion and return downward ("backwards") along the upward-inclined portion 130 and then smoothly transition into and enter the downward embankment portion 140 to point "C." These "low-energy" riders 150 will thereafter continue the flume ride along the lower flume path 170. On the other hand, if all of the associated kinetic energy is not depleted when the rider 150 and/or ride vehicle 125 reaches the crest of the uphill embankment (point "B"), then the rider 150 and/or ride vehicle 125 will continue over the crest of the uphill embankment. These "high-energy" riders 150 will thereafter continue the flume ride along the upper flume path 160.

Those skilled in the art will appreciate that the uphill embankment portion 130 may be more broadly characterized as an "energy threshold gate." Such a gate may be positioned at any selected or desired point along a slide path in order to successively intercept moving riders and/or ride vehicles and to redirect them to one or more auxiliary paths. Broadly speaking, an energy threshold gate functions to deplete from each successive rider and/or ride vehicle entering the gate a threshold amount of kinetic energy and/or momentum. Such energy depletion may be accomplished via an uphill incline, as in FIG. 1A, or, alternatively, other means may be used, such as friction surfaces, brakes, pools of static water that riders and/or ride vehicles splash through, momentum transfers via injected water flow, water jets, and/or the like. Whatever energy depletion mechanism is used, the energy threshold gate is able to thereby discriminate and separate successive riders and/or ride vehicles moving along the slide path and through the gate according to whether their associated kinetic energy and/or momentum is greater than or less than the threshold amount. The downward embankment portion 140 provides a first auxiliary path 170 that is arranged and adapted to receive and pass riders and/or ride vehicles whose kinetic energy and/or momentum is greater than the threshold amount depleted by the energy threshold gate. The portion of the sliding surface 110 extending beyond the uphill embankment 130 provides a second auxiliary path 160 that is arranged and adapted to receive and pass riders and/or ride vehicles whose kinetic energy and/or momentum is greater than the threshold amount depleted by the energy threshold gate.

Thus, in accordance with this embodiment of the present invention each rider's and/or ride vehicle's path through the flume ride 100 is not predetermined, but may be randomly determined or otherwise altered according to the relative amount of kinetic and potential energy possessed by the riders 150 and/or ride vehicle 125. For convenience of description, this random or multi-path slide effect is referred to herein an "over-under" slide effect because the particular path taken by the rider 150 and/or ride vehicle 125 will depend on whether the kinetic energy of the rider(s) and/or ride vehicle is over or under the predetermined threshold amount necessary to overcome the potential energy at the crest of the uphill embankment 130. Of course, this is not to suggest that the effect is limited to only two possible paths. Alternatively, multiple "upper" and/or "lower" paths may be provided in conjunction with multiple crests and corresponding kinetic energy thresholds for directing riders along any number of multiple flume paths as may be required or desired.

Figure 1B:
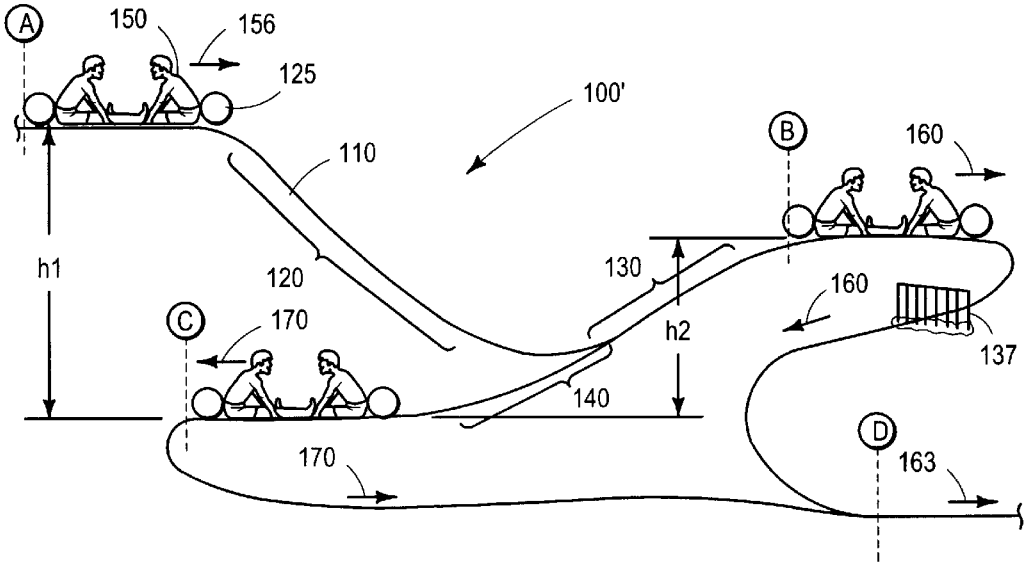

The remaining portions of the flume ride may be completely different for the high-energy and low-energy riders or, alternatively, their paths may rejoin at some point downstream of the over-under effect. For example, FIG. 1B illustrates the scenario where the upper and lower paths converge and then rejoin at a lower elevation (point "D"). In this case, preferably the length and relative slope of each alternative path is preferably coordinated and timed so as to avoid possible collision of successive low-energy and higher-energy riders at the point of rejoining. Alternatively, the upper and lower flume paths may not rejoin and may even further diverge and split via additional over-under effects at such downstream portions as may be desired.

In any event, preferably both the upper and lower flume paths treat the riders to different ride experiences or journeys. For example, the upper path may take riders along an exciting twisting/turning ride flume (the "reward") while the lower path may take riders through a water fall (see, e.g., FIG. 1B—shower 137) that dumps water all over them and gets them soaked (the "penalty"). This arrangement can thus create an exciting game or competition, encouraging riders 150 to try to increase or decrease their kinetic energy going into the over-under effect by selecting heavier or lighter passengers, by paddling or dragging hands/feet in the water, by ducking or raising heads/arms/torsos so as to increase or decrease wind resistance, etc. The reward could also be things like redemption points, longer or "extended" ride experience and/or the opportunity to repeat the ride experience without having to wait in line. If desired, certain flume paths (e.g. the upper path) may also lead to "secret" exit/splash pools and/or play areas that can only be accessed by successfully navigating through one or more over-under effects. Thus, more skilled riders will learn how to adjust and/or alter their kinetic energy in order to navigate successfully through the various over-under effects, while less skilled riders will have an incentive to repeat the ride in order to hone their skills. There are boundless other possibilities and fun variations for exploiting the invention disclosed herein.

FIGS. 2–8 illustrate an alternative preferred embodiment of a water flume ride 200 having features and advantages in accordance with the present invention. For purposes of illustration and ease of description and understanding, elements similar to those described above may be denoted with similar reference numerals. However, it is to be recognized that these elements may or may not be the same as or identical to those described above.

As illustrated in FIGS. 2–6, the flume ride 200 generally comprises an elongated, generally continuous main tube or enclosure 203 extending from a higher elevation defining a start platform 205 to a lower elevation defining a splash or exit pool 215. The tube 203 may be round or ovular in cross section (or any other preferred shape, such as square, hexagonal, trapezoidal, etc.) and preferably has a generally smooth inner surface defining a sliding surface 210 upon which a rider 250 and/or ride vehicle 225 can slide (see, e.g., FIG. 8). The sliding surface 210 is preferably lubricated with a flow of water 207, which may be conveniently caused to flow from the upper start pool 205, down and along substantially the entire length of the tube 203, to the exit or splash pool 215. A recirculation pump and/or other suitable means (not shown) may be used to provide the desired amount of water flow and concomitant lubrication of the sliding surface 210, in accordance with basic design and hydraulics principles well known to those skilled in the art. Alternatively, the sliding surface 210 (and/or the under surface of the ride vehicle 225) may be coated or otherwise selected to have a lubricious (or rolling) contact surface so that water lubrication may be reduced, if desired, and/or omitted altogether (e.g., for a "dry" slide or a ride using a rolling vehicle).

In the preferred embodiment illustrated, the tube enclosure 203 is preferably between about 60 inches and 100 inches (1.5–2.5 m) at its widest diameter, although smaller or larger enclosures (and/or a mixture thereof) may also be used. A practical range for most typical applications will between about 30 inches and 200 inches (0.75–5.0 m) at the widest diameter. While, an enclosed tube 203 is preferred, as in the illustrated embodiment depicted by FIGS. 2–8, alternative embodiments may include open toughs and/or partially open tubes or troughs, or alternating open and enclosed tubes or troughs, as design expedients may dictate or as otherwise desired. Open tube and/or trough sections may be provided in virtually any and all widths and lengths desired.

The total length of the main tube enclosure 203 is preferably between about 400 and 600 feet (122–183 m), with a practical range being between about 200 feet and 1000 feet (61–305 m), or longer, for most typical applications. The total drop in elevation from start pool 205 to splash/exit pool 215 is preferably between about 60 feet and 80 feet (18–24 m), with a practical range for typical applications being between about 30 feet and 100 feet (9–30 m), or more. Of course, those skilled in the art will appreciate that any number of additional open sections, transition sections, water effects, slide effects, and/or the like may be added at any variety of selected points along the main tube enclosure 203, as design needs or requirements dictate.

Figure 3:
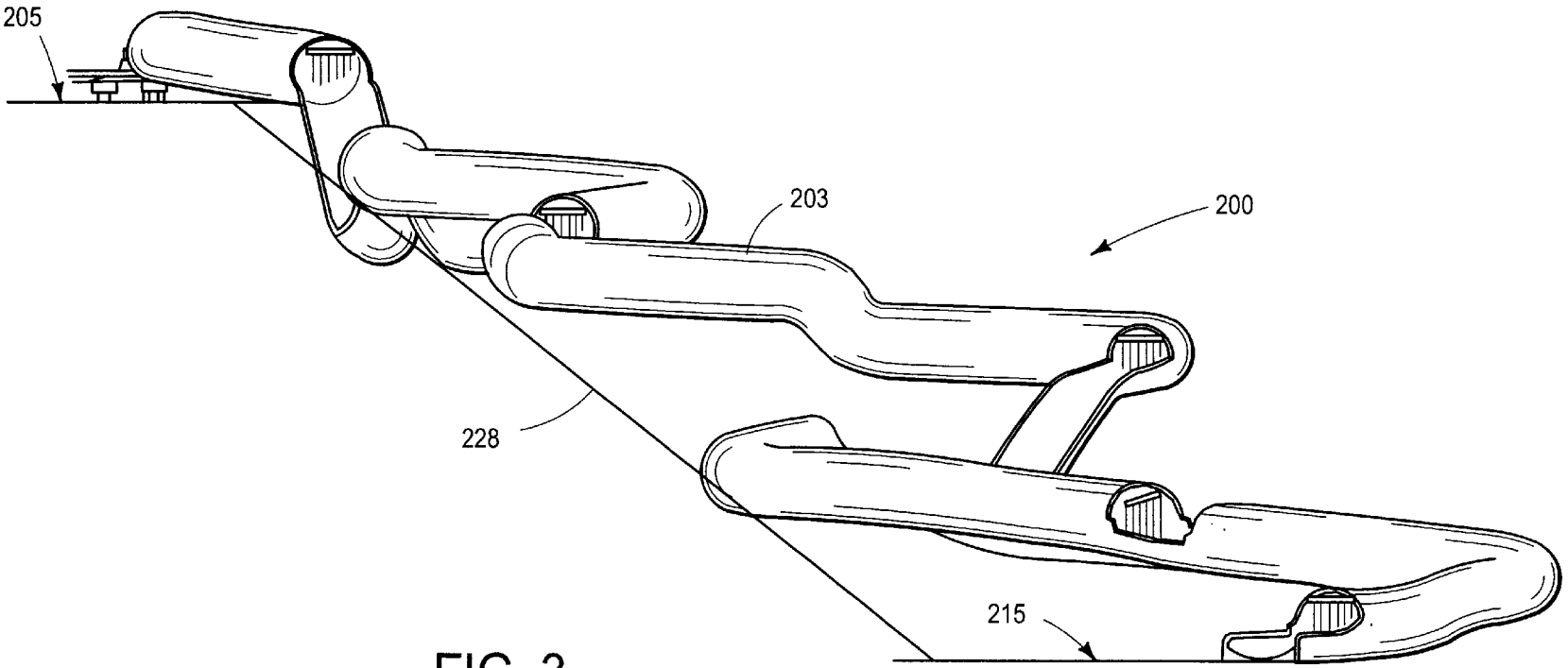
FIG. 3 is a side elevation view of the water flume ride of FIG. 2.
Figure 4:
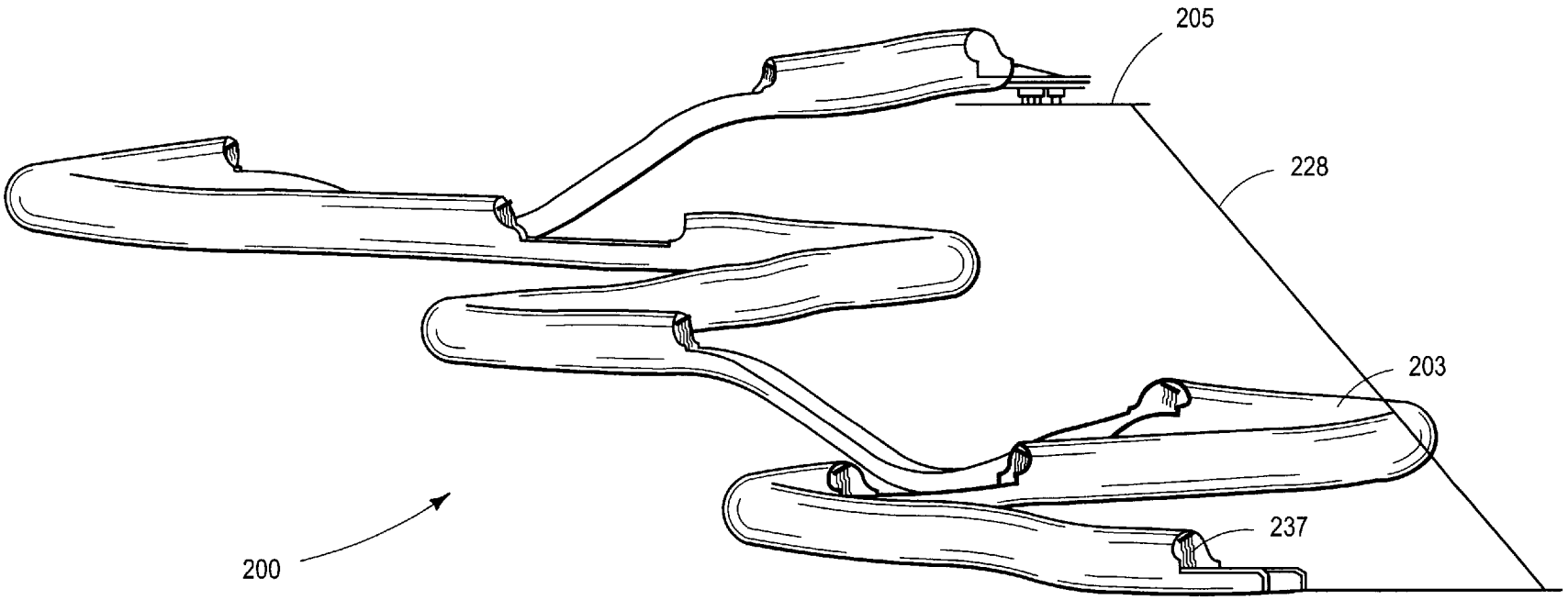
FIG. 4 is a front elevation view of the water flume ride of FIG. 2.
Figure 5:
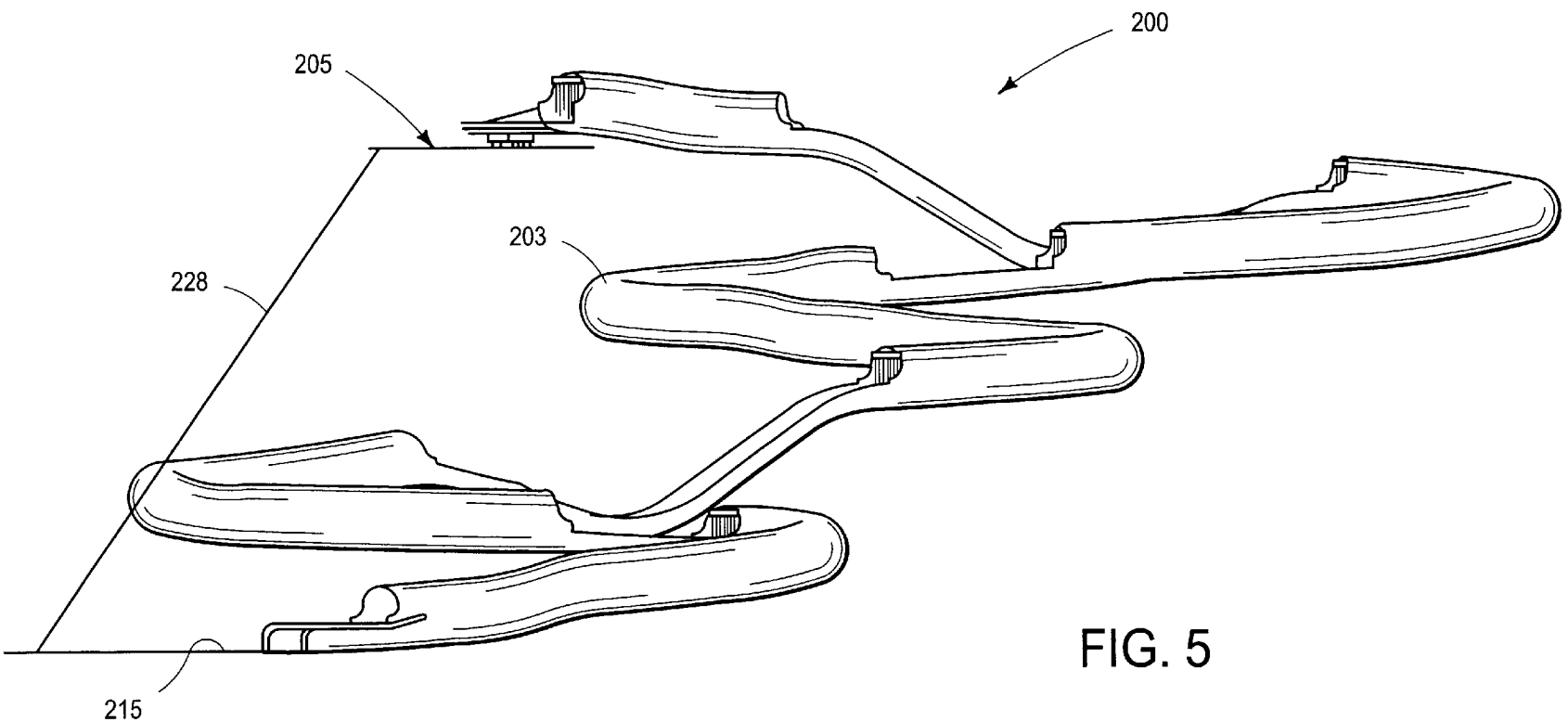
FIG. 5 is a rear elevation view of the water flume ride of FIG. 2.
Figure 6:
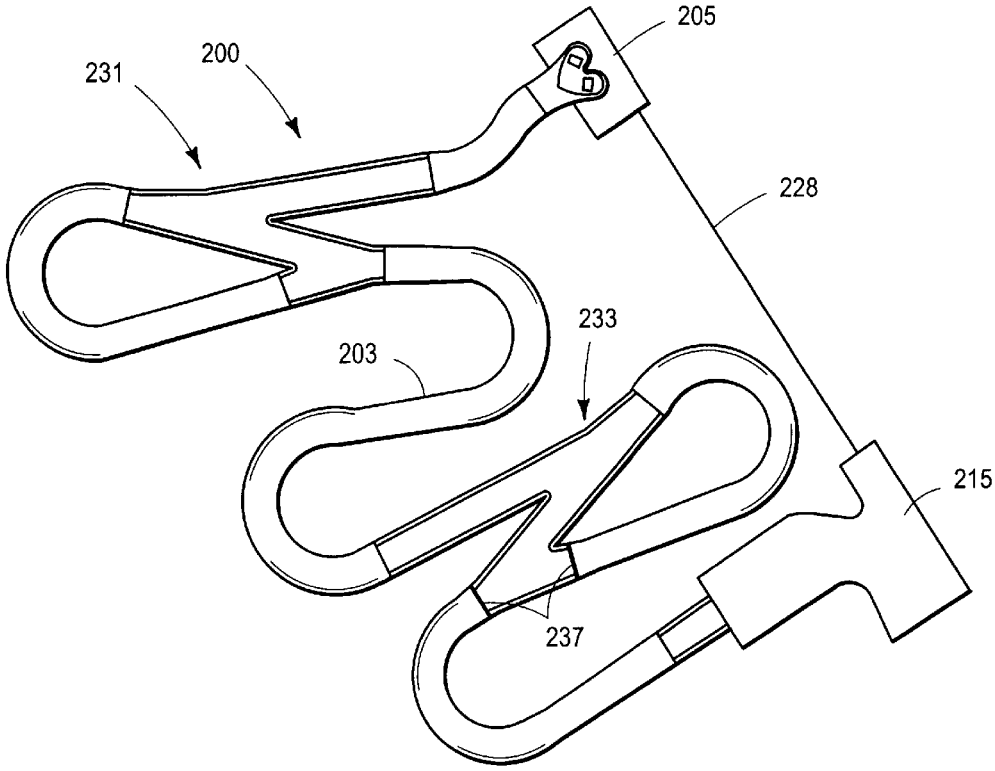
FIG. 6 is a top plan view of the water flume ride of FIG. 2.

As illustrated in FIGS. 3–5, the tube 203 preferably winds and bends its way generally downward from the higher elevation 205 to the lower elevation 215 in a substantially smooth and continuous manner. The gradient of descent is preferably no less than about 5–10% on average, with a practical range for most typical applications being between about 10% and 80%, on average. Of course, the gradient of descent (or ascent) at any point along the tube 203 may range from essentially 0% to 100% (free fall or vertical climb) and anywhere in between, depending upon the specific ride design parameters. The particular slope, number and sharpness of turns, bends and other undulations may be selected in accordance with well-known design principles so as to provide an interesting and exciting ride experience for riders, while at the same time maintaining a safe and injury-free ride environment. Optionally, and/or in addition, the path of the tube 203 may be arranged so as to generally follow the natural grade or slope of an adjacent hillside or other geological feature upon which the ride 200 may be constructed. In any event, the tube 203 is preferably firmly supported along its length by suitable support structures, such as concrete pylons, footings, pads, truss supports and/or similar supporting structures well known in the art. Optionally, multiple tubes may provided between the higher and lower elevations and sharing a common support structure. The multiple tubes may be arranged to run either generally parallel to one another and/or intertwined or interwoven with one another so as to provide enhanced fun and overall ridership capacity.

An optional conveyer 228 or the like (shown here schematically) may be used to continuously transport riders and/or ride vehicles from the lower elevation 215 to the higher elevation 205. This may comprise a simple belt-driven conveyer for recirculating ride vehicles (see, e.g., FIGS. 11–14), or it could comprise one or more stairs, gondolas, chair lifts, uphill water injection "Master Blaster"® water rides and/or associated components (see, e.g., U.S. Pat. No. 5,213,547 to Lochtefeld, incorporated herein by reference), or other similar structures well-known in the art. In the preferred embodiment, a belt conveyer 228 is provided for continuously recirculating ride vehicles, while a separate stair-tower or climbing structure (not shown) is provided for allowing riders to ascend from the lower elevation to the higher elevation to thereby access the flume ride 200.

The tube 203 may be conveniently fabricated from preformed fiberglass material and/or other suitable reinforced or composite materials well-known in the art. Alternatively, some or all portions of the tube 203 may be formed of plastic, cement, gunite, ceramic, metal and/or other suitable materials or combinations thereof, giving due consideration for the need to provide adequate support and rigidity to the ride and to provide a smooth sliding surface. Preformed fiberglass is most preferred because of its low cost, design flexibility and ease of manufacture and assembly. Most preferably, the tube 203 is entirely or substantially entirely constructed from a plurality of preformed fiberglass sections and mating components, which are assembled and bolted together on-site. Advantageously, such sections or components can be fabricated in a range of standard shapes and sizes so as to facilitate inexpensive design and assembly of a wide variety of variously configured and sized flume rides having features and advantages as disclosed herein.

Figure 2:
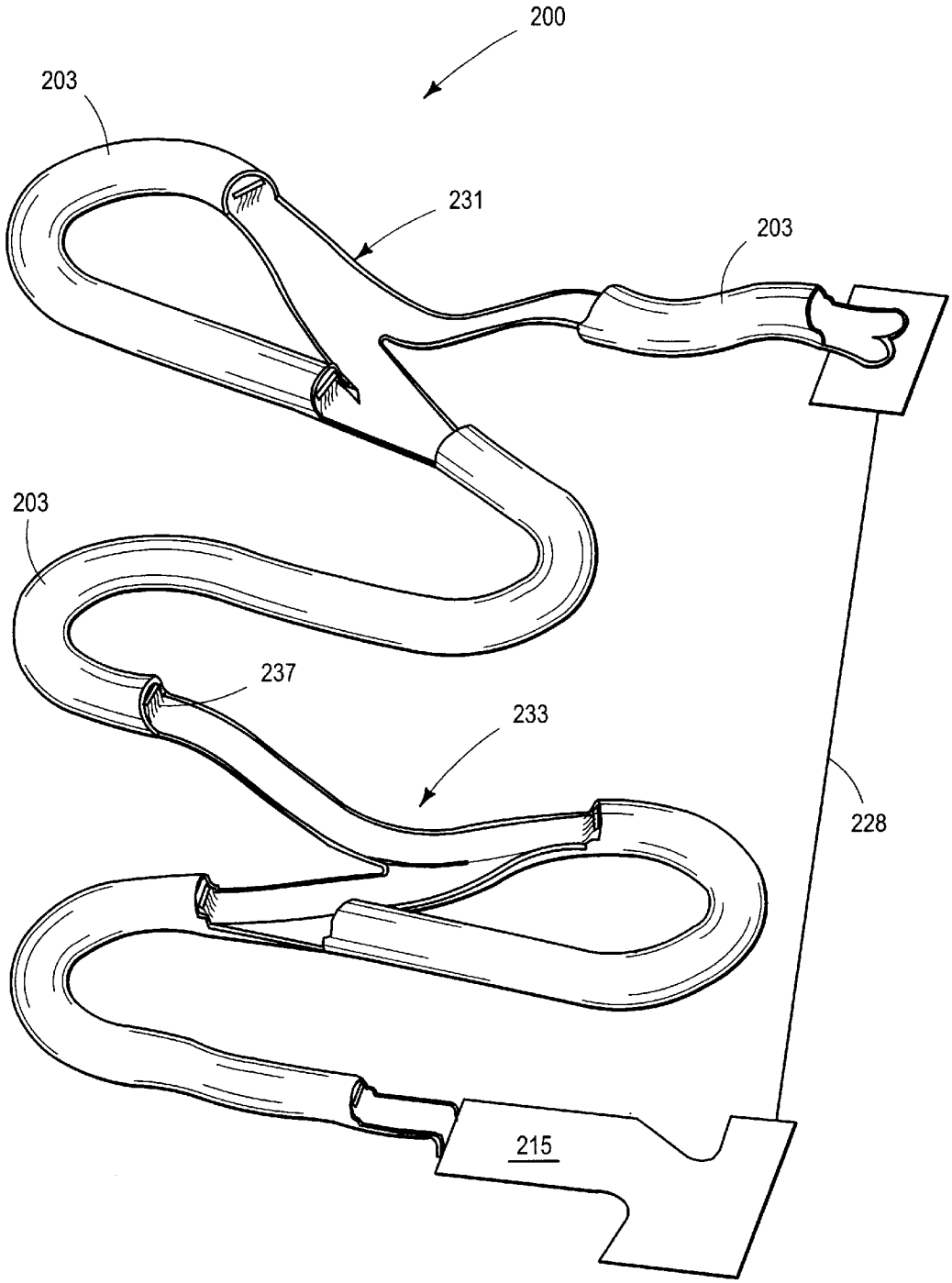
FIG. 2 is a perspective view of an alternative embodiment of a water flume ride having features and advantages in accordance with the present invention.
Figure 7:
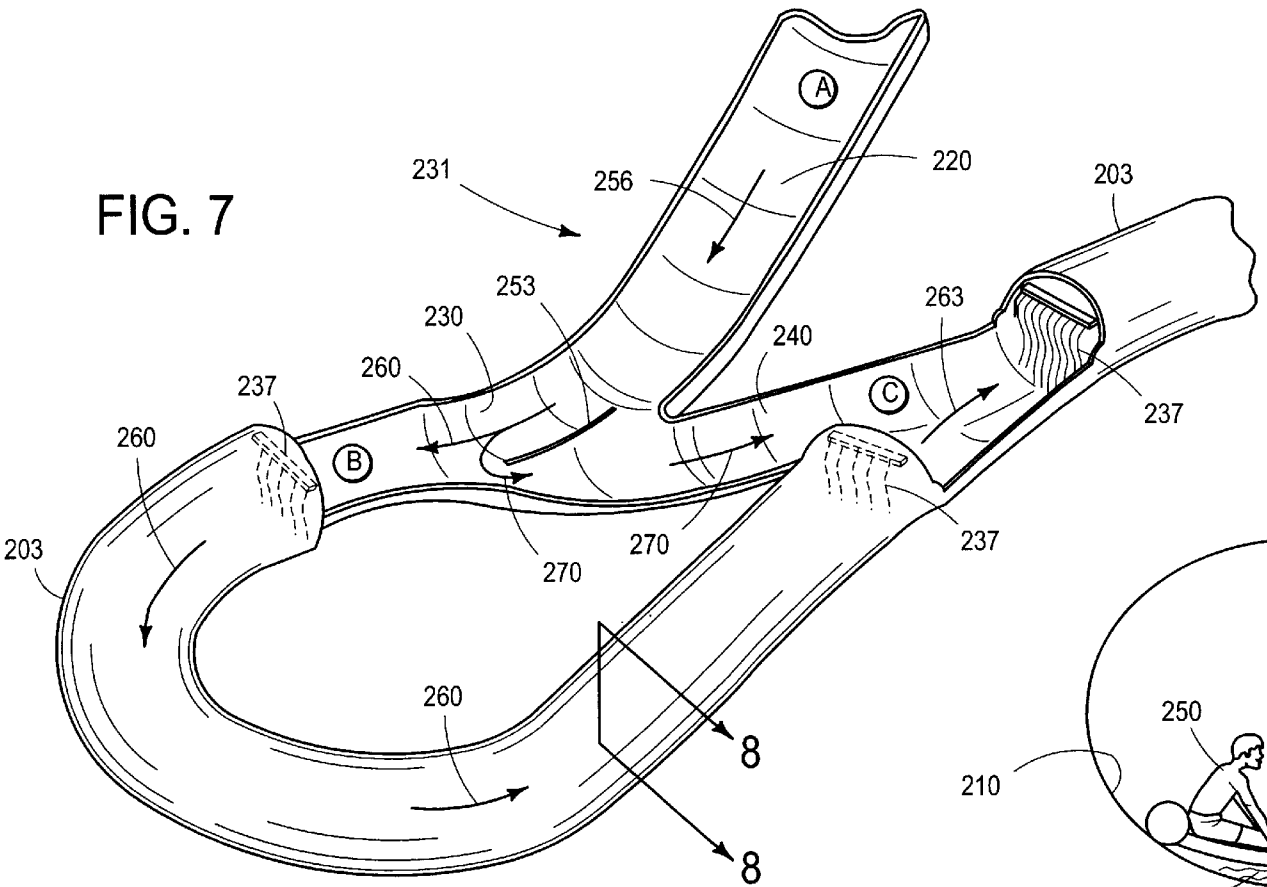
FIG. 7 is a detail perspective view of an over-under slide effect for use in the water flume ride of FIG. 2 and having features and advantages of the present invention.
Figure 8:
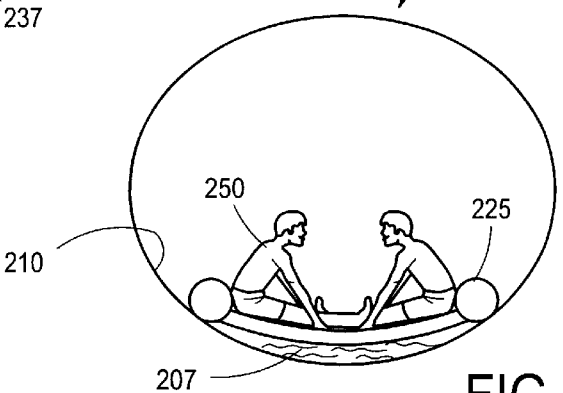
FIG. 8 is a detail cross-sectional view of the tube and riding surface comprising a portion of the water flume ride of FIG. 2.
Figure 11:
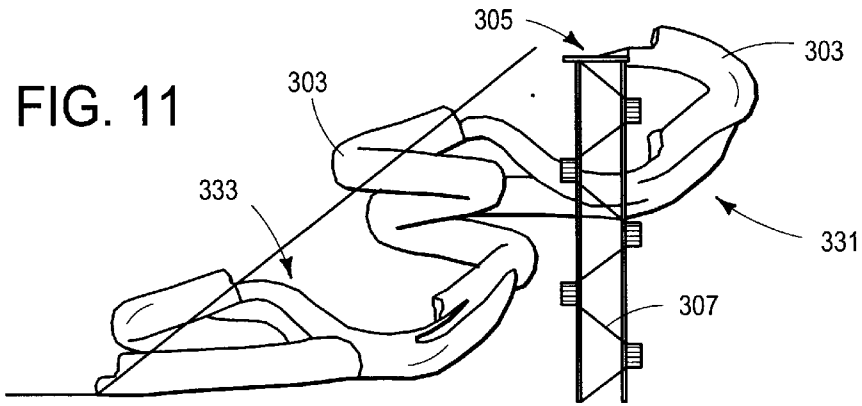
FIG. 11 is a front perspective view of the water flume ride of FIG. 9.
Figure 10:
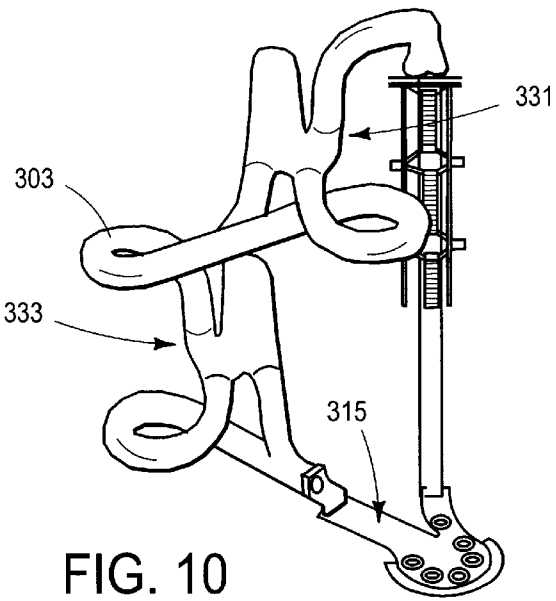
FIG. 10 is a side elevation of the water flume ride of FIG. 9.
Figure 9:
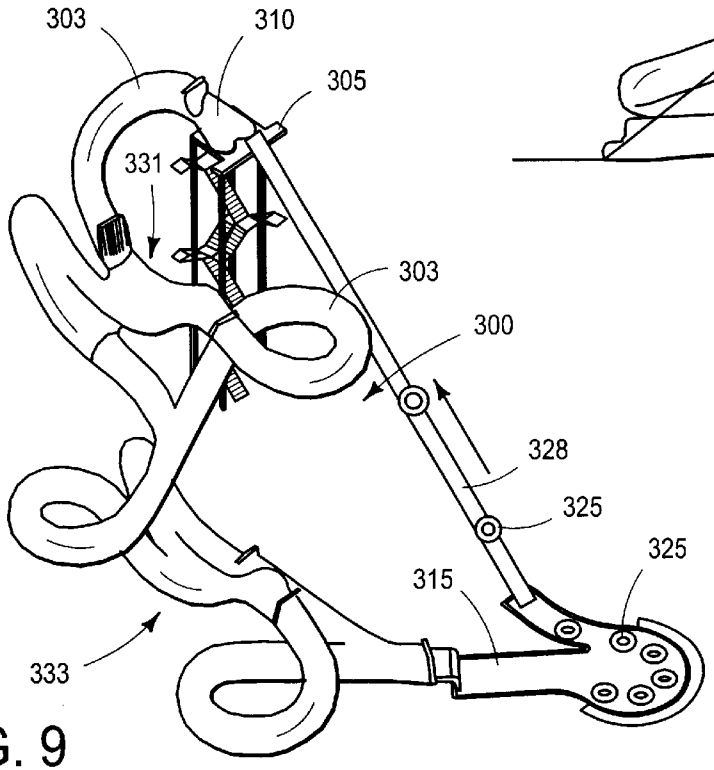
FIG. 9 is a perspective view of an alternative embodiment of a water flume ride having features and advantages in accordance with the present invention.
Figure 12:
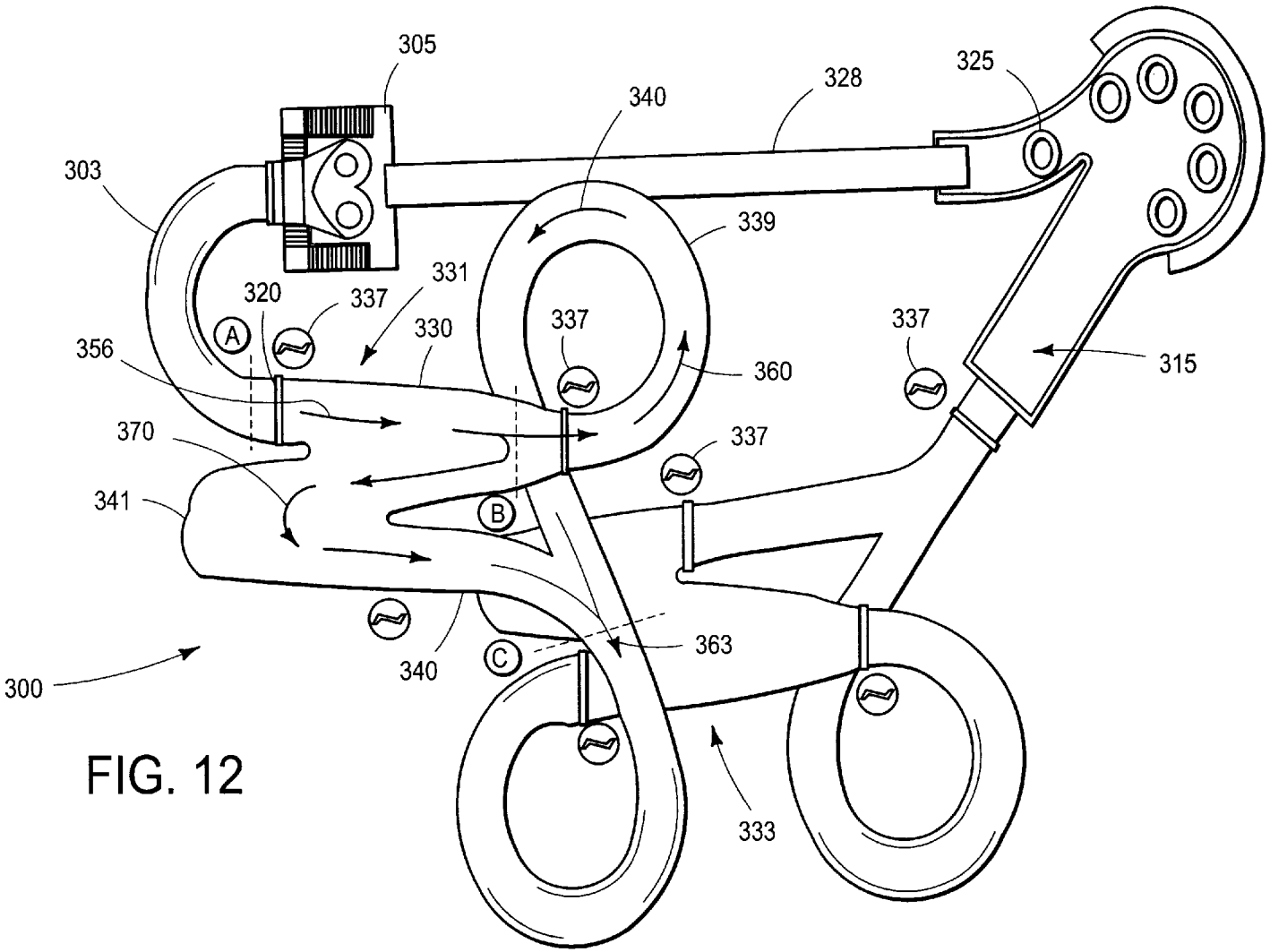
FIG. 12 is a top plan view of the water flume ride of FIG. 9.

The particular flume ride 200 illustrated comprises two "over-under" slide effects 231, 233. These are as generally disclosed and described above in connection with FIGS. 1A and 1B. Of course, those skilled in the art will readily appreciate that flume ride 200 may alternatively be configured with more or less over-under effects and/or other effects, as desired. FIG. 7 is a detail perspective view of an over-under slide effect 231 as generally illustrated in FIG. 2, having features and advantages of the present invention. For ease of explanation and understanding the directions of gravity-induced flow (direction of rider travel) along the ride surface 210 are indicated by arrows 256, 260, 263, 270.

As indicated, a first downward-inclined trough 220 extends downward from the main tube 203 (see FIG. 2). From a first elevation generally at point "A" the first downward-inclined trough 220 descends in a direction indicated by arrow 256 and then substantially smoothly transitions into an upward-inclined trough 230. The upward-inclined trough 230 ascends at least slightly (preferably substantially) in elevation, culminating in a crest or inflection at point "B" at a second elevation, lower than the first elevation. A second downward-inclined trough 240 adjoins the upward-inclined trough 230, as illustrated, and is preferably divided therefrom by a gradually diminishing ridge line 253 defining the intersection between the two troughs. The second downward-inclined trough 240 is preferably arranged generally parallel to and at a relative elevation at least slightly below that of the upward-inclined trough 230 at the point where they adjoin. Optionally, the apex of the ridge line 253 may contain and/or be provided with a cushion of water to help reduce the rider/vehicle's coefficient of friction and also reduce the rider/vehicle's kinetic energy.

In operation, riders 250 (see, FIG. 8) slide via their bodies and/or via a flexible riding mat or ride vehicle 225 along the flume ride within main tube 203. When riders enter the over-under slide effect 231, starting at point "A" the riders and their vehicle initiate a downward descent along the first downward-inclined trough 220 in a direction generally indicated by arrow 256. During this portion of the ride, the riders 250 and/or the ride vehicle 225 gain kinetic energy and momentum due to the resulting decrease in elevation and the lubriciousness of the sliding contact against sliding surface 210. As the riders 250 transition into and enter the upward-inclined trough 230, some or all of the riders' and/or vehicle's kinetic energy will be dissipated as friction and/or will be converted into potential energy. If all of this kinetic energy is dissipated and/or converted to potential energy before the riders reach the crest of the upward-inclined trough 230 at point "B" ("low-energy riders") then the riders and/or ride vehicle will reverse motion and return downward and slide along the "lower flume path" generally indicated by arrow 270. On the other hand, if all of the kinetic energy is not depleted when the riders and/or ride vehicle reach the crest of the upward-inclined trough 230 ("high-energy riders), then the riders and/or ride vehicle will continue in their forward motion, first sliding under the waterfall 237 and then continuing along the "upper flume path" generally indicated by arrow 260.

Advantageously, with the present invention each rider's and/or ride vehicle's path through the flume ride 200 is not predetermined, but is randomly affected and/or is otherwise determined by the relative amounts of kinetic and potential energy possessed by the riders and/or ride vehicle. The particular path taken by the riders and/or ride vehicle will depend on whether the kinetic energy of the rider(s) and/or ride vehicle entering the slide effect 231 is over or under the predetermined threshold amount necessary to overcome both friction losses and the potential energy at the crest of the upward-inclined trough 230.

In the particular embodiment illustrated, the upper flume path 260 loops around, passes through a second waterfall 237 and eventually reconverges with the lower flume path 270 and reconnects to the main tube 203 at point "C" at a third elevation, lower than the first and second elevations. However, those skilled in the art will readily appreciate that the upper and lower flume paths need not immediately reconverge. Alternatively, the upper and/or lower flume paths 260, 270 may take riders through any number and variety of additional bends, twists, turns, additional downhill and/or uphill portions, undulations and/or other slide effects as may be desired. Thus, it is easily conceivable and even desirable that the remaining portions of the flume ride could be substantially different and/or completely different for the high-energy and low-energy riders, including such further divergences and splits via additional over-under effects as may be desired.

Optionally, the flume ride 200 and the over-under effect(s) may be configured so as to make one or the other of the upper or lower flume paths more desirable. For example, and as noted briefly above, the upper path may take riders along an exciting twisting/turning ride flume (the "reward") while the lower path may take riders through multiple water falls that dump water all over them and get them soaked (the "penalty"). This can create an exciting competition and thereby encourage riders to try and achieve the appropriate or desired amount of kinetic energy going into each over-under effect (e.g., by selecting heavier or lighter passengers, adding weight to the vehicle by partially filling it with water, paddling or dragging hands/feet in the water, ducking or raising heads/arms/torsos so as to increase or decrease wind resistance, etc.). If desired, the reward could also be redemption points, a longer ride and/or the opportunity to repeat the ride without having to wait in line. Optionally, the flume ride 200 could be configured such that certain flume paths (e.g., upper or lower flume path) may lead to a "secret" hidden oasis and/or other play area hidden within the waterslide complex that can only be accessed by successfully navigating through one or more over-under effects. Thus, riders are encouraged to repeat the ride experience perhaps many times in order to eventually discover and enjoy the secret oasis and/or other desirable effects. Those skilled in the art will readily appreciate the many other boundless possibilities and fun variations for exploiting the invention.

FIGS. 9–12 illustrate an alternative preferred embodiment of a water flume ride 300 having features and advantages in accordance with the present invention. Again, for purposes of illustration and ease of description and understanding, elements similar to those described above may be denoted with similar reference numerals. However, it is to be recognized that these elements may or may not be the same as or identical to those described above.

As illustrated, the flume ride 300 generally comprises an elongated tube or enclosure 303 extending from a higher elevation defining a start platform 305 to a lower elevation defining a splash or exit pool 315. The tube 303 is preferably of a round or ovular cross section similar to that described above in connection with FIG. 8. The tube 303 also preferably has a generally smooth inner surface defining a sliding surface 310 upon which a rider (not shown) and/or ride vehicle 325 can slide. The preferred size, shape, materials and fabrication of the enclosure 303 is substantially as described above in connection with FIGS. 2–8 and, therefore, will not be repeated here in the interest of brevity. An enclosed tube 303 is preferred, as illustrated; however, alternative embodiments may include partially open tubes and/or fully open tubes or troughs, or alternating open and enclosed tubes, or any other combination thereof, as design expedients may dictate or as desired.

As with the flume embodiments described above, the sliding surface 310 is preferably wetted with a flow of water, which flows from the upper start pool 305, down and along substantially the entire length of the tube 303, to the exit or splash pool 315. The water provides cooling fun for the ride participants, and also provides a lubricious film or fluid between the rider/vehicle and the ride surface so as to increase the speed of the rider down the flume path. The water may be conveniently recirculated from the lower elevation to the higher elevation using one or more pumps. A recirculation pump and/or other suitable means (not shown) may be used to provide the desired amount of water flow and lubrication along the sliding surface 310, in accordance with well-known hydraulics principles. Alternatively, the sliding surface (and/or the ride vehicle) may be coated or otherwise selected to have a lubricious (or rolling) contact surface so that water lubrication may be omitted (e.g., for a "dry" slide or a ride with a rolling vehicle).

The start platform 305 is preferably elevated a substantial distance above the splash pool 315—preferably between about 0.5 and 3 meters for every 10 meters of slide run). One or more flights of stairs 307 are provided for facilitating climbing access by ride participants (not shown). Alternatively, an elevator, escalator, chair lift, gondola, climbing structure and/or any other suitable means may be used to enable ride participants to safely access the flume ride 300. An optional conveyer system 328 is preferably provided for continuously and automatically lifting ride vehicles 325 for reuse by riders waiting at the start platform 305. Alternatively, if the ride vehicles are relatively small and portable (or if no ride vehicle is used) then the conveyer 328 may be omitted if desired.

Figure 14A:
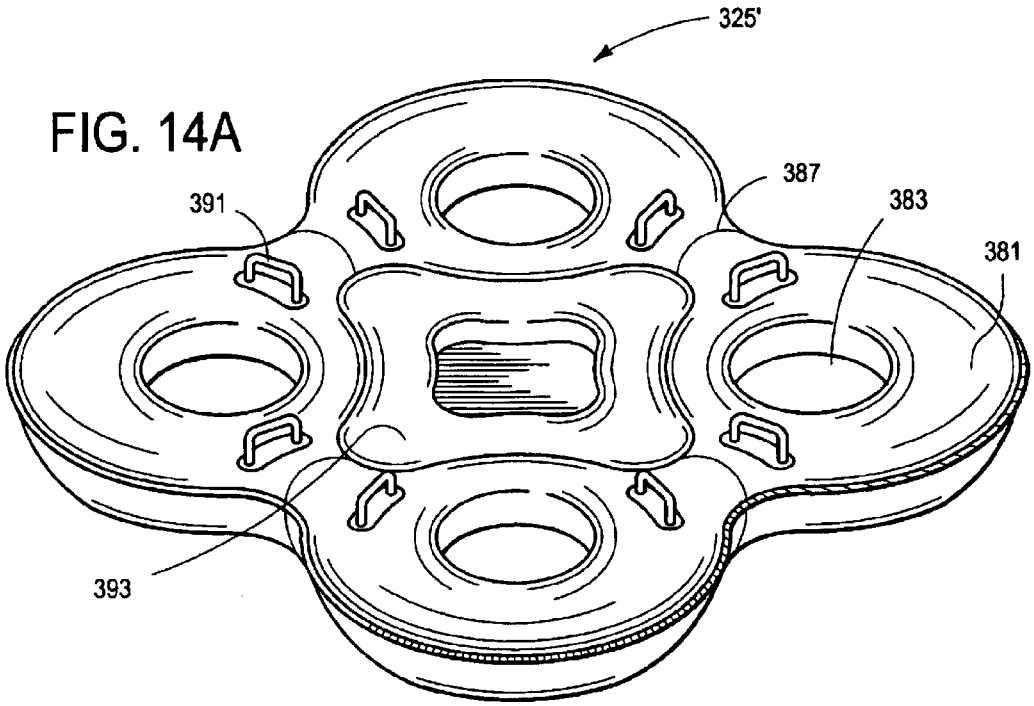
FIGS. 14A–C are perspective, corner and side elevation views, respectively of an integral quadruple tube ride raft vehicle for use with a water flume ride having features and advantages of the present invention.
Figure 14B:
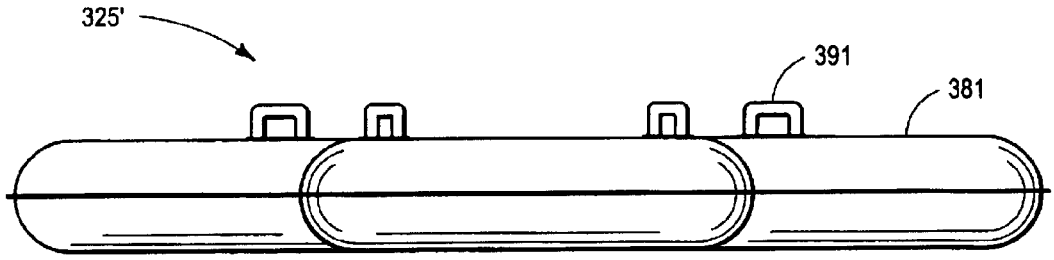
Figure 14C:
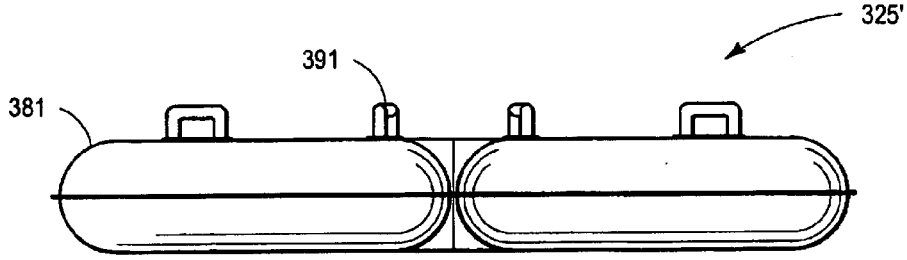

The ride vehicles 325 preferably comprise inflatable multi-passenger inner tubes, such as illustrated in FIGS. 13–14. Most preferably, one or more multi-tube vehicles are provided which can accommodate three or more riders per vehicle with riders sitting facing one another. Preferably (although not necessarily), each ride vehicle 325 is rotationally symmetrical or omni-directional such that its orientation is randomly and continuously determined as it slides down the water flume ride 300. For example, FIGS. 13A–C are perspective, and two side elevation views (rotated 60 degrees relative to one another), respectively, of one preferred embodiment of an integral triple-tube ride raft vehicle 325 for use with a water flume ride having features and advantages of the present invention. FIGS. 14A–C are perspective, and two side elevation views (rotated 45 degrees relative to one another), respectively, of one preferred embodiment of an integral quadruple-tube ride raft vehicle 325' for use with a water flume ride having features and advantages of the present invention. In each case the ride vehicle 325, 325' generally comprises an inflatable vessel fabricated from a durable, puncture resistant material, such as fabric-reinforced rubber, plastic, vinyl, PVC and/or the like. The particular embodiments illustrated comprise three or four substantially identical conjoined frusto-toroidal tube portions 381. Preferably, these are simultaneously and integrally formed via suitable plastic injection molding and/or rubber casting operations. Alternatively, the tube portions 381 may be separately and individually formed and then conjoined by sewing and/or welding overlapping material along one or more seams 387, as indicated. Each tube 381 provides a central opening forming a seating area for one or more riders thereon. This opening may or may not be closed at the bottom, depending whether or not it is desired to get riders wet. If desired, optional handles 391 may be provided on an upper surface of each tube portion 381 to facilitate gripping thereof by each rider. An optional central reinforcement portion 393 comprising a web of plastic or rubber material may be provided for added strength, if desired.

The particular flume ride 300 illustrated comprises two "over-under" slide effects 331, 333. The over-under effects 331, 333 are as generally disclosed and described above in connection with FIGS. 1A, 1B, 7, the particular details of which will not be repeated here in the interest of brevity. In this case, however, each upper flume path 360 comprises a loop-around 339 while each lower flume path 370 comprises a high-bank return. 341, as illustrated. In each case, the upper and lower flume paths 360, 370 rejoin downstream flume path 363, as in the examples described above in connection with FIG. 1B and FIGS. 2–8. Of course, those skilled in the art will readily appreciate that the flume ride 300 may alternatively be configured with more or less over-under effects and/or other effects, and with or without rejoining flume paths, as desired.

In operation, riders (not shown) slide via their bodies and/or via a flexible riding mat or ride vehicle 325 (FIGS. 13, 14) along the flume ride within main tube 303. When riders enter the first over-under slide effect 331, starting at point "A" the riders and their vehicle initiate a downward descent through a first waterfall 337 and along a first downward-inclined trough 320 in a direction generally indicated by arrow 356. During this portion of the ride, the riders and/or the ride vehicle gain kinetic energy and momentum due to the resulting decrease in elevation and the lubriciousness of the sliding contact against sliding surface 310. The riders then transition into and enter an upward-inclined trough 330, wherein some or all of the riders' and/or vehicle's kinetic energy will be dissipated as friction and/or will be converted into potential energy. If all of this kinetic energy is dissipated and/or converted to potential energy before the riders reach the crest of the upward-inclined trough 330 at point "B" ("low-energy riders") then the riders and/or ride vehicle will reverse motion and return downward and slide along the "lower flume path" generally indicated by arrow 370. In this case, the lower flume path 370 leads riders into embanked return 341 wherein the rider's path is caused to reverse again before entering and sliding down downhill slide 340 and continuing along the path indicated by arrows 370 and 363. On the other hand, if all of the kinetic energy is not depleted when the riders and/or ride vehicle reach the crest of the upward-inclined trough 330 ("high-energy riders), then the riders and/or ride vehicle will continue in their forward motion, first sliding under a waterfall 337 and then continuing along the "upper flume path" generally indicated by arrow 360. In this case, the upper flume path 360 leads riders into a loop-around 339 wherein riders loop around a circuitous path indicated by arrows 360, eventually rejoining path 363. This ride action then repeats downstream for the second over-under effect 333.

As with the various embodiments of the invention illustrated and described above, the flume ride 300 in accordance with the present embodiment allows each rider's and/or ride vehicle's path through the flume ride 300 to be randomly determined and/or otherwise affected by relative amounts of kinetic and potential energy possessed by the riders and/or ride vehicle. The particular flume path (either upper or lower) taken by the riders and/or ride vehicle will depend on whether the kinetic energy of the rider(s) and/or ride vehicle entering each slide effect 331, 333 is over or under the predetermined threshold amount necessary to overcome both friction losses and the potential energy at the crest of the upward-inclined trough 330.

As noted above, the upper flume path 360 passes through a second waterfall 337 and then loops around, eventually reconverging with the lower flume path 370 at point "C".

However, those skilled in the art will readily appreciate that the upper and lower flume paths need not reconverge. Alternatively, the upper and/or lower flume paths 360, 370 may take riders through any number and variety of additional bends, twists, turns, additional downhill and/or uphill portions, undulations and/or other slide effects, as desired. Thus, some or all remaining portions of the flume ride experience could be substantially different and/or completely different for the high-energy and low-energy riders, including possible further divergences and splits via additional over-under effects, if desired.

The flume ride 300 and the over-under effect(s) 331, 333 may also be optionally configured so as to provide riders with a reward (or penalty) for successfully entering one or the other of the upper or lower flume paths 360, 370. For example, and as noted above, the upper path 360 may be reconfigured to take riders along an exciting twisting/turning ride flume (the "reward") while the lower path may be reconfigured to take riders through multiple additional water falls 337 that dump water all over them and get them soaked (the "penalty"). This can create an exciting competition to encourage riders to achieve the appropriate or desired amount of kinetic energy going into each over-under effect 331, 333 (e.g., by selecting heavier or lighter passengers, adding weight to the vehicle by partially filling it with water, paddling or dragging hands/feet in the water, ducking or raising heads/arms/torsos so as to increase or decrease wind resistance, etc.). If desired, the reward could also be redemption points, a longer ride and/or the opportunity to repeat the ride without having to wait in line. Optionally, the flume ride 300 could be configured such that certain flume paths (e.g., upper or lower flume path) may lead to a "secret" hidden oasis and/or other play area hidden within the waterslide complex that can essentially only be accessed by successfully navigating through one or more over-under effects. Thus, riders would be encouraged to repeat the ride experience again and again until they are able to successfully navigate the various over-under effects and thereby "discover" and enjoy the secret oasis and/or other suitable reward. Of course, those skilled in the art will readily appreciate the many other boundless possibilities and fun variations for exploiting the invention.

In the particular embodiment illustrated, preferably (although not necessarily) the length and downhill grade of the upper and lower flume paths 360, 370 are appropriately coordinated and timed such that the time for a rider to traverse each randomly determined path from a defined beginning point to a defined ending point is substantially approximately equal. If multiple ride paths are provided that do not reconverge, and/or if multiple ride paths are provided that further diverge via additional over-under effects, then preferably (although not necessarily) the length and downhill grade of all possible flume path combinations are such that the time for a rider to traverse each randomly determined path from a defined beginning point to a defined ending point is substantially approximately equal. Advantageously, in this manner while the rider's path would be effectively random (or otherwise not predetermined), the overall flume ride operation would still be highly predictable to the ride operator because the various flume paths would preferably (although not necessarily) be timed to have the same or substantially the same ride duration. Thus, the ride in accordance with this particular preferred embodiment of the invention would be able to sustain relatively high rider and/or ride vehicle throughput, with start intervals of between about 10 to 20 seconds, and more preferably about 15 seconds, being possible.

Finally, it should be pointed out that while the various preferred embodiments illustrated and described above are all configured for use as a wet water ride using one or more multi-passenger ride vehicles, those skilled in the art will readily appreciate that a flume ride and/or other similar ride could alternatively be configured and used with or without a ride vehicle and as either a dry slide and/or a water slide. Moreover, while gravity induced rider/vehicle movement along the various sliding surfaces is preferred, those skilled in the art will readily appreciate that any or all portions of the various sliding surface and/or riding vehicles may be power assisted, for example, via water injection "Master Blaster"®-type devices, conveyer belts, chain drive mechanisms, rider-operated devices, braking devices, and/or the like. Moreover, the ride vehicle and/or riders thereon may be equipped, if desired, with one or more rider-operated devices for selectively admitting and/or expelling water into the vehicle in order to increase or decrease its mass for purposes of altering its kinetic energy before entering an over-under effect. This may comprise, for example, a simple pump and/or one or more on-board or out-board water-pockets for receiving and temporarily storing a desired quantity of water.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. In a flume ride comprising a generally downwardly-inclined main slide path comprising a flume sized and adapted to carry one or more riders and/or ride vehicles sliding thereon along a defined ride path wherein each of the riders and/or ride vehicles has a kinetic energy and/or momentum associated therewith, a multi-path slide effect for safely intercepting at least some of the riders and/or ride vehicles and redirecting them to one or more auxiliary slide paths, comprising:

an energy threshold gate positioned at a selected desired point along the main slide path and being sized and adapted to successively intercept moving riders and/or ride vehicles and to deplete therefrom a threshold amount of kinetic energy and/or momentum, said energy threshold gate being adapted to thereby discriminate and separate successive riders and/or ride vehicles according to whether their associated kinetic energy and/or momentum is greater than or less than said threshold amount;

a first auxiliary slide path comprising a flume sized and adapted to guide one or more riders and/or ride vehicles sliding thereon along a defined path and arranged and adapted to receive and pass riders and/or ride vehicles whose kinetic energy and/or momentum is greater than said threshold amount as determined by the energy threshold gate; and a second auxiliary slide path comprising a flume sized and adapted to guide one or more riders and/or ride vehicles sliding thereon along a defined path and arranged and adapted to receive and pass riders and/or ride vehicles whose kinetic energy and/or momentum is less than said threshold amount as determined by the energy threshold gate.

2. A multi-path slide effect as recited by claim 1, wherein said energy threshold gate comprises an uphill embankment portion culminating in a crest.

3. A multi-path slide effect as recited by claim 1, wherein said energy threshold gate comprises an uphill embankment portion culminating in a crest and further comprising a subsequent first downhill embankment portion defining said first auxiliary slide path and a second downhill embankment portion generally adjoining the uphill embankment portion defining said second auxiliary slide path.

4. A multi-path slide effect as recited by claim 3, wherein said first or second auxiliary slide paths rejoin the main slide path.

5. A multi-path slide effect as recited by claim 3, wherein said first or second auxiliary slide paths do not rejoin the main slide path.

6. A multi-path slide effect as recited by claim 1, wherein said energy threshold gate comprises an uphill embankment portion culminating in a crest and further comprising a subsequent first downhill embankment portion defining said first auxiliary slide path and a second downhill embankment portion generally adjoining the uphill embankment portion defining said second auxiliary slide path, and wherein said threshold gate and said first and second auxiliary slide paths are arranged and configured so as to cause successive riders and/or ride vehicles sliding down the main slide path to slide up the uphill embankment portion, thereby converting at least some of the kinetic energy of the rider and/or ride vehicle to potential energy, and whereby: (i) if all of the kinetic energy is depleted before the rider and/or ride vehicle reaches the crest of the uphill embankment portion, the rider and/or ride vehicle substantially reverses direction, and slides back down the uphill embankment portion and continues down the second downhill embankment portion along the second auxiliary path; or (ii) if all of the kinetic energy is not depleted before the rider and/or ride vehicle reaches the crest of the uphill embankment portion, the rider and/or ride vehicle substantially continues in motion and slides over the crest of the uphill embankment and down the first downhill embankment portion along the first auxiliary path.

7. A water flume ride comprising a main slide path and two or more multi-path slide effects as recited by claim 1.

8. A water flume ride as recited by claim 7 wherein said main slide path is sized and adapted to carry a flow of water and one or more riders thereon.

9. A water flume ride as recited by claim 7 wherein said main slide path is sized and adapted to carry one or more ride vehicles thereon.

10. A water flume ride as recited by claim 9 wherein said main slide path is sized and adapted to carry one or more multi-passenger ride vehicles thereon.

11. A flume ride for allowing one or more riders to slide along a sliding surface, comprising:

a flume path comprising a tube enclosure and/or trough sized and adapted to carry a flow of water and one or more riders or ride vehicles thereon;

a first generally downhill portion transitioning into an uphill embankment portion culminating at a crest;

a first divergent flume path comprising a second generally downhill portion following the crest of the uphill embankment portion;

a second divergent flume path comprising a third generally downhill portion extending generally parallel to and at least partially adjoining the uphill embankment portion;

the first, second and third downhill portions and the uphill embankment portions all being sized and arranged such that one or more riders sliding along the flume ride slide down the first downhill portion and up the uphill embankment, and then continue sliding either: (i) over the crest of the uphill embankment and down the second downhill portion comprising the first divergent flume path, or (ii) back down the uphill embankment portion and down the third downhill portion comprising the second divergent path.

12. A flume ride as recited by claim 11, wherein said first and second divergent flume paths rejoin.

13. A flume ride as recited by claim 11, wherein said first and second divergent flume paths do not rejoin.

14. A flume ride as recited by claim 11 wherein said sliding surface comprises a tube enclosure and/or trough, including multiple bends, twists and/or turns, said tube enclosure and/or trough being sized and adapted to carry a flow of water and one or more riders and/or ride vehicles thereon.

15. A water flume ride as recited by claim 11 wherein said sliding surface comprises a tube enclosure and/or trough having a diameter of between about 30 and 200 inches and adapted carry one or more riders and/or ride vehicles thereon.

16. A water flume ride as recited by claim 11 wherein said sliding surface is sized and adapted to carry one or more multi-passenger ride vehicles thereon.

17. A water flume ride comprising a primary flume portion comprising a substantially enclosed tube, an uphill embankment, and two or more adjoining secondary flume portions comprising open or enclosed tubes or troughs, the secondary flume portions providing mutually exclusive ride paths depending upon the level of kinetic energy of a rider and/or ride vehicle ascending toward the crest of the uphill embankment.

18. In a slide or flume ride comprising a generally downwardly-inclined main slide path carrying moving riders and/or ride vehicles sliding thereon, a method for safely intercepting at least some of the riders and/or ride vehicles and redirecting them to one or more auxiliary slide paths, comprising the following steps:

providing or forming at one or more selected points along the main slide path an uphill embankment portion culminating in a crest and a subsequent first downhill embankment portion defining a first auxiliary slide path comprising a contained tube or trough;

providing a second downhill embankment portion generally adjoining the uphill embankment portion defining a second auxiliary slide path comprising a contained tube or trough;

causing each successive rider and/or ride vehicle sliding down the main slide path to slide up the uphill embankment portion, thereby converting at least some of the kinetic energy of the rider and/or ride vehicle to potential energy, and whereby: (i) if all of the kinetic energy is depleted before the rider and/or ride vehicle reaches the crest of the uphill embankment portion, the rider and/or ride vehicle substantially reverses direction, and slides back down the uphill embankment portion and continues down the second downhill embankment portion along the second auxiliary path; or (ii) if all of the kinetic energy is not depleted before the rider and/or ride vehicle reaches the crest of the uphill embankment portion, the rider and/or ride vehicle substantially continues in motion and slides over the crest of the uphill embankment and down the first downhill embankment portion along the first auxiliary path.

19. The method of claim 18 comprising the further step of allowing the path of each successive rider and/or ride vehicle to be randomly determined.

20. The method of claim 18, comprising the further step of selectively increasing or decreasing the mass of one or more ride vehicles sliding along the main slide path.

21. The method of claim 20, wherein the step of selectively increasing or decreasing the mass of one or more ride vehicles comprises filling or draining one or more pockets of water on the ride vehicle.

22. The method of claim 18, comprising the further step of selectively increasing or decreasing the kinetic energy of one or more ride vehicles sliding along the main slide path.

23. The method of claim 18, wherein the step of selectively increasing or decreasing the kinetic energy of one or more ride vehicles comprises one or more of the following: sliding over a friction surface, applying a brake, sliding through a puddle of water, or transferring momentum to selected vehicles via injected water flow and/or one or more water jets.

24. In a slide or flume ride comprising a generally downwardly-inclined main slide path carrying moving riders and/or ride vehicles sliding thereon, a method for safely intercepting at least some of the riders and/or ride vehicles and redirecting them to one or more auxiliary slide paths, comprising the following steps:

providing or forming at one or more selected points along the main slide path an uphill embankment portion culminating in a crest and a subsequent first downhill embankment portion defining a first auxiliary slide path;

providing a second downhill embankment portion generally adjoining the uphill embankment portion defining a second auxiliary slide path;

causing each successive rider and/or ride vehicle sliding down the main slide path to slide up the uphill embankment portion, thereby converting at least some of the kinetic energy of the rider and/or ride vehicle to potential energy, and whereby: (i) if all of the kinetic energy is depleted before the rider and/or ride vehicle reaches the crest of the uphill embankment portion, the rider and/or ride vehicle substantially reverses direction, and slides back down the uphill embankment portion and continues down the second downhill embankment portion along the second auxiliary path; or (ii) if all of the kinetic energy is not depleted before the rider and/or ride vehicle reaches the crest of the uphill embankment portion, the rider and/or ride vehicle substantially continues in motion and slides over the crest of the uphill embankment and down the first downhill embankment portion along the first auxiliary path; and selectively increasing or decreasing the mass of one or more riders and/or ride vehicles sliding along the main slide path by filling or draining one or more pockets of water.

* * * * *